US005918625A

United States Patent [19]

Ziehm

[11] Patent Number: 5,918,625

[45] Date of Patent: Jul. 6, 1999

[54] INTEGRAL WATER CIRCULATION APPARATUS

[76] Inventor: Raymond G. Ziehm, 6650 S. Sheridan Blvd., Littleton, Colo. 80123-6854

[21] Appl. No.: 08/957,831

[22] Filed: Oct. 27, 1997

[51] Int. Cl.[6] ..... F24H 1/00

[52] U.S. Cl. ..... 137/357; 137/563; 137/564; 137/337; 126/362

[58] Field of Search ..... 137/339, 563, 137/564, 357, 337; 126/362

[56] References Cited

U.S. PATENT DOCUMENTS

| | | | |
|---|---|---|---|
| 2,265,108 | 12/1941 | Berman | 126/362 |
| 3,190,284 | 6/1965 | Koepf | 126/362 |
| 4,917,142 | 4/1990 | Laing et al. | 137/337 |
| 5,331,996 | 7/1994 | Ziehm | 137/337 |
| 5,622,203 | 4/1997 | Givier et al. | 126/362 |

FOREIGN PATENT DOCUMENTS

| | | | |
|---|---|---|---|
| 47809 | 9/1978 | Germany | 137/337 |

*Primary Examiner*—A. Michael Chambers
*Attorney, Agent, or Firm*—William E. Hein

[57] ABSTRACT

An integral water circulation apparatus supplies instant hot water at hot water faucets remotely located from the building water heater through a convective circulation flow of hot water from the water heater It is therefore simpler in design, less expensive to install, and more reliable than the more complex prior art systems. It has the further advantages of not mixing heated water with cold water being supplied to cold water faucets throughout the building and of preventing cold water from flowing up the return line to the hot water faucet

4 Claims, 1 Drawing Sheet

INTEGRAL WATER CIRCULATION APPARATUS

BACKGROUND AND SUMMARY OF THE INVENTION

This invention relates generally to apparatus for providing instant hot water at remotely located hot water faucets within residential and small commercial buildings and, more particularly to an inexpensive, yet reliable, hot water circulation apparatus that maintains hot water at such remote faucets through natural convective circulation flow from the existing building water heater.

Considerable time and water are wasted daily while consumers await hot water at faucets remotely located from the building water heater. In some plumbing installations, this delay may be up to two minutes, which results in wasting up to 8,000 liters of water annually in the average home, to say nothing of the attendant frustration. Many attempts at resolving this problem have been made. One such attempt has been the installation of auxiliary remote water heaters, either under sinks in proximity to the remote faucet or in a basement located beneath the sink above. Another such attempt at providing instant hot water at remote faucets has involved bringing heated water from the existing water heater to the faucet via the existing hot water pipe serving that faucet and circulating it back to the water heater through a separate return line.

Exemplary of systems employing auxiliary water heaters is that described in U.S. Pat. No. 4,236,548 to Howard. However, initial purchase and installation costs of auxiliary water heaters has limited their acceptance. In addition, they consume valuable under-counter space if located near the remote faucet. Some auxiliary heaters are intended to provide limited quantities of very hot water at a faucet that is entirely separate from the usual hot water faucet for the specialized purpose of providing very hot water for instant soups and beverages. These specialized auxiliary water heaters are unrelated to the present invention.

Water circulation systems are generally grouped as either convective or pumped circulation systems. Exemplary of convective circulation systems are those described in U.S. Pat. No. 3,929,153 to Hasty and U.S. Pat. No. 2,255,460 to Weaver. These systems employ water supply pipes to the remote faucet that are positioned to slope upwardly and return lines from the faucet back to the water heater inlet that are positioned to slope downwardly. Such systems are difficult to implement, especially in existing buildings. Many of these systems, as recognized by Hasty, also suffer the disadvantage of some water in the cold water pipe being mixed with hot return line water, which then must be wasted if cold water is desired at a cold water faucet. Heating of the cold water is a common problem in circulation systems, and many installations do not lend themselves to the replumbing that is required to minimize this problem.

Pumps employed in recirculation systems, such as those described in U.S. Pat. No. 3,669,351 to Meier and U.S. Pat. No. 4,142,515 to Skaats are functional, but require electrical power that may not be readily available in the desired location. These systems are very complex, requiring motors, seals, switches, timers, control electronics, and electrical wiring for proper operation. These components are not only expensive, but they are subject to failure. Operational costs to operate the pump will be incurred, and a pump may produce noise that could be objectionable to some people. The Skaats patent also recognizes the undesirable tendency of some water circulation systems to heat the cold water in the cold water distribution pipe by the warm water from the return water line.

While the aspirator activated hot water circulation systems described by the present inventor in his U.S. Pat. No. 5,331,996 and U.S. Pat. No. 5,518,022 will perform well in all situations, whether or not convective flow is possible, or where only a small return line can be installed, the present invention will operate in a significant percentage of domestic applications in which the water heater is in the basement and the remote hot water faucet is on the first or a higher floor, or in which the remote hot water faucet is a minumum of one meter above the water heater.

The present invention provides an integral water circulation apparatus for supplying instant hot water at hot water faucets remotely located from the building water heater through a convective circulation flow of hot water from the water heater. It is therefore simpler in design, less expensive to install and more reliable than the more complex prior art systems. It has the further advantages of not mixing heated return line water with cold water being supplied to cold water faucets throughout the building and of preventing cold water from flowing up the return line to the hot water faucet

DETAILED DESCRIPTION OF THE INVENTION

Figure 1:
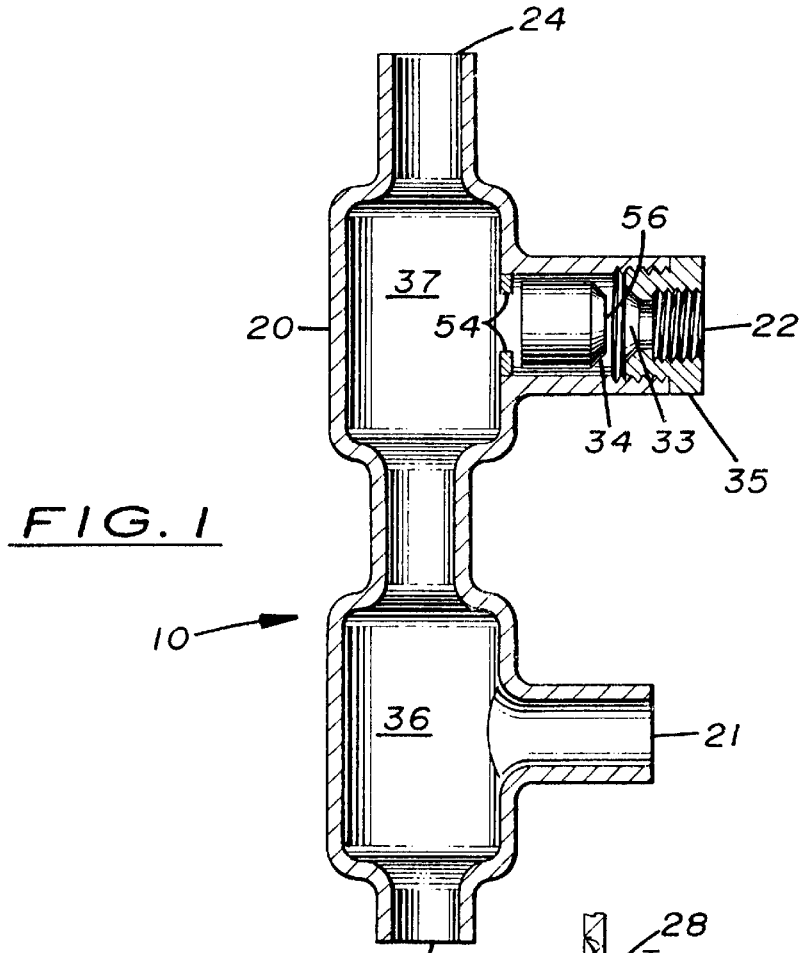
FIG. 1 is a sectional pictorial diagram of the water circulator of the present invention.

Referring now to FIG. 1, there is shown a water circulator 10 constructed in accordance with the present invention. Water circulator 10 includes a housing 20 having a pair of shaped internal chambers 36, 37, a main water inlet 21, a return inlet 22, a cold water outlet 23, and a heater supply outlet 24. Internal chamber 36 serves as a cold water chambers while internal chamber 37 serves as a hot water chamber. A check valve 33 is integrally associated with return inlet 22. Housing 20 is configured to provide isolation of water flowing through return inlet 22 from water flowing through cold water outlet 23. Water circulator 10 is preferably fabricated from a commercially available material such as CPVC that has a low coefficient of thermal conductivity to minimize heat conduction to cold water chamber 36. It is important that water circulator 10, be installed with the hot water chamber 37 above cold water chamber 36 in order to take advantage of local convective forces within water circulator 10, especially during periods of no water usage within the building. The cross section of housing 20 between cold water chamber 36 and hot water chamber 37 is reduced to minimize the structural and water conductive paths between the two chambers and to restrict any cross flow of water between them due to turbulence.

Figure 2:
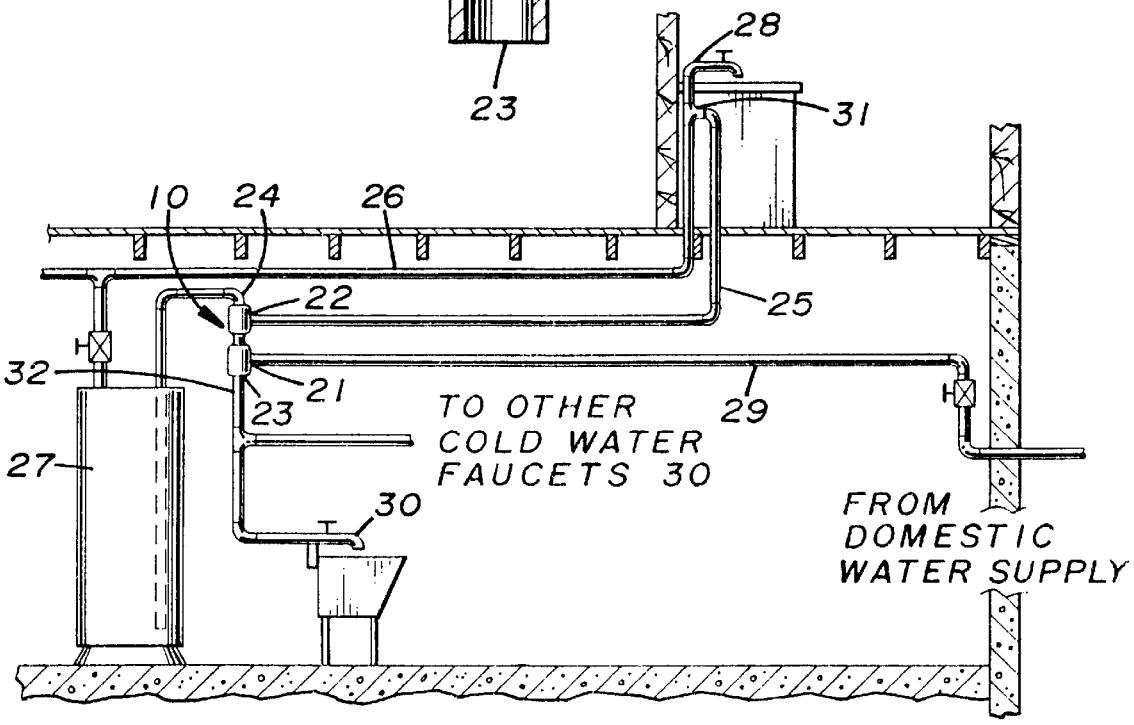
FIG. 2 is a pictorial diagram illustrating the water circulator of FIG. 1 installed within a typical residential water system.

Return inlet 22 houses a fast acting check valve 33 that allows water to flow into the return inlet 22, but that will close to prevent water from flowing out. The check valve 33 employs a poppet 34 that has a specific gravity at or near 1.0 to minimize gravity effects on its operation. The poppet 34 is constrained from moving into the warm water chamber 37 by barrier lugs 54 that will nevertheless allow water to flow through unimpeded. A front portion 56 of poppet 34 is shaped to matingly engage a valve seat situated in a return inlet fitting 35 to thereby effect closure against back flow through return inlet 22. The cold water outlet 23 is situated down stream of the main water inlet 21 and upstream of the return inlet 22 and the heater supply outlet 24, such that cold water flowing from the main inlet 21 to the cold water outlet 23 does not mix with warm water flowing from the return inlet 22 and out the heater supply outlet 24. The relative positioning and attitude of the cold water outlet 23 to the return inlet 22 is crucial to avoid mixing of warm return line water with cold water flowing out the cold water outlet 23. Physical separation of the cold water from the warm return line water, along with the configuration and orientation of the chambers serve to minimize any local conductive and convective heat transfer between hot and cold water, yet allow water to flow from the main inlet 21 to each outlet unimpeded Referring now to FIG. 2, the water circulator 10 of the present invention may be installed in a typical residential water distribution system having a return line 25 coupled between the return inlet 22 of water circulator 10 and the conventional hot water line 26 serving a remote hot water faucet 28 by means of a tee fitting in the hot water line 26 serving remote hot water faucet 28. As illustrated, the tee fitting is positioned in close proximity to remote hot water faucet 28. The main water inlet 21 of water circulator 10 is connected to a cold water supply line 29 that serves the building to provide cold water to a plurality of cold water taps 30 and to a conventional water heater 27. The cold water outlet 23 of water circulator 10 is connected to a cold water pipe 32 that serves a plurality of cold water taps 32 within the building The heater supply outlet 24 of water circulator 10 is connected to the cold water inlet of water heater 27. When installed as described above, water circulator 10 prevents contamination of cold water supplied to the cold water taps 30 by warm water flowing into water circulator 10 from the return line 25.

Operation of a residential water system in which water circulator 10 is installed may be understood by again referring to FIG. 2. Convective flow in the circulation loop is due to the fact that the hot water in hot water pipe 26 has a lower density than water in the return line 25 that has cooled slightly The water in the hot water pipe 26 rises, thereby forcing the cooler water in the return line 25 to descend toward the lowest point in the loop. As water flows down the return line 25, it is replaced by additional hot water from the heater 27, flowing through the hot water pipe 26 and the tee 31, thereby establishing a continuous low volume circulating flow. As further cooling takes place in the return line 25, the density difference between the water in the hot water pipe 26 and water in the return line 25 becomes larger, increasing the circulation flow rate. The water circulation loop is from the heater 27, through the hot water pipe 26 and the return line 25, into the water circulator 10, through the check valve 33, up and out through the supply outlet 24, and then back to the heater 27. Insulation placed on the hot water pipe 26 between the heater 27 and the remote hot water faucet 28 will enhance this convective flow.

Water flow through the water circulator 10 will follow three different paths in response to four different operating conditions. When no water is being used in the building, convective flow will occur in the system, with water entering the water circulator 10 through the return inlet 22 and exiting through the heater supply outlet 24. Normal convection will cause the hot water entering the hot water chamber 37 from the return inlet 22 to rise toward the heater supply outlet 24 and will not allow it to circulate downward into the cold water chamber 36 and cold water outlet 23. Hence, there will be no heating of the cold water pipes. Likewise, the cold water entering the cold water chamber 36 from the cold water inlet 21 will drop downward toward the cold water outlet 23 due to its higher density. Tests conducted on water circulator 10 in an actual residential environment have shown that the upper internal chamber 37 is heated by the return line flow, while the lower internal chamber 36 remains cool or cold. Convective flow for the unit is excellent, keeping the water temperature at the remote hot water faucet 28 above 40 degrees C. at all times. In addition to not heating the cold water pipe 29, the warm water from the return line 25 is sent directly to the inlet of water heater 27, thus conserving thermal energy by minimizing the need for the burner of water heater 27 to cycle on.

Under the second conditions in which a cold water faucet 30 is opened, a lower pressure condition will exist at the cold water outlet 23 of water circulator 10 and water will flow from the main water inlet 21 directly to the cold water outlet 23. No cold water will flow into the hot water chamber 37 or out of the heater supply outlet 24. Hot water from the heater 27 will not backflow down into the cold water outlet 23 and no heating of the cold water pipes will occur. Convective circulation flow as in the previously discussed condition will continue since the forces implementing it have not changed.

Under the third condition s in which a hot water tap, other than hot water tap 28 served by water circulator 10, is opened, a situation similar to the second condition exists, except that the water flow will enter from the main inlet and proceed directly to the heater supply outlet 24. Normal convective flow from the return line 25 will continue through the heater supply outlet 24 into the inlet of water heater 27. When the hot water faucet 28 is opened, water will enter from the main inlet 21 and proceed to the heater supply outlet 24 as described above. However, the pressure in the return line 25 and at the return inlet 22 will be reduced, thereby causing the check valve 33 to close to prevent reverse flow. Convective flow will cease as long as hot water faucet 28 remains open; however, the water at faucet 28 will remain hot due to heated water flowing from the water heater 27 through the hot water pipe 26.

Under the fourth condition in which hot and cold faucets in the building are opened simultaneously, water will flow from the main inlet 21 to the cold water outlet 23 and t o the heater supply outlet 24. Convective flow will continue normally, except that if the hot water faucet 28 is open the check valve 33 will close to prevent reverse flow.

From the above description of the present invention, it will be appreciated that when installed in a typical residential water distribution system, water circulator 10 will efficiently maintain hot water at remote hot water faucets, will not heat the cold water supplying cold water faucets, and will prevent reverse flow in the return line. Water circulator 10 requires no electrical power or gas, and will perform reliably and without noise. It eliminates the need to waste water while waiting for cold water to flush the warmed water from the cold water pipe when a cold water faucet is opened. Hot water will always be instantly available at hot water faucets, while cold water will be available at cold water faucets. Since water circulator 10 provides the convenience of instant hot water and can be priced inexpensively to the consumer, it has the potential for significant water conservation.

I claim:

1. A water circulator for providing instant hot water to a remotely located hot water faucet within a building, the water circulator comprising a housing, within which are formed upper and lower internal chambers, the upper and lower internal chambers being connected by a passageway having a cross sectional area smaller than a cross sectional area of each of said upper and lower internal chambers, said lower internal chamber having a cold water inlet coupled to a cold water supply line for the building and having a cold water outlet coupled to a pipe supplying cold water faucets throughout the building, said upper internal chamber having a heater supply outlet coupled to an inlet of a conventional water heater serving the building and having a return inlet coupled to one end of a return line, the other end of the return line being coupled, proximate a remotely located hot water faucet within the building, to a hot water line serving that hot water faucet, said return inlet of said upper internal chamber having a check valve therein to prevent the flow of water out of said return inlet.

2. A water circulator as in claim 1 wherein said check valve includes a poppet having a specific gravity substantially equal to 1.0.

3. A system for providing instant hot water to a remotely located hot water faucet within a buildings the system comprising:

a main water line providing cold water to the building;

a conventional water heater for receiving cold water through the main water line and heating it for distribution to a plurality of hot water faucets within the building;

a hot water distribution line coupled to the water heater for distributing hot water to the plurality of hot water faucets within the building;

a cold water distribution line for distributing cold water entering the building through the main water line to a plurality of cold water faucets within the building;

a water circulator comprising a housing, within which are formed upper and lower internal chambers, the upper and lower internal chambers being connected by a passageway having a cross sectional area smaller than a cross sectional area of each of said upper and lower internal chambers, said lower internal chamber having a cold water inlet coupled to said main water line for the building and having a cold water outlet coupled to said cold water distribution line serving cold water faucets throughout the building, said upper internal chamber having a heater supply outlet coupled to an inlet of said water heater and having a return inlet, the return inlet having a check valve therein to prevent the flow of water out of said return inlet; and a return line connected between said return inlet of said water circulator and said hot water distribution line proximate a remotely located one of said hot water faucets within the building.

4. A water circulator as in claim 3 wherein said check valve includes a poppet having a specific gravity substantially equal to 1.0.

* * * * *